US005791246A

United States Patent [19]

Kelm

[11] Patent Number: 5,791,246

[45] Date of Patent: Aug. 11, 1998

[54] DEVICE FOR EFFECTING AN IMPRESSION THROW-ON AND THROW-OFF OF A CYLINDER

[75] Inventor: Carsten Kelm, Mannheim, Germany

[73] Assignee: Heidelberger Druckmaschinen AG, Heidelberg, Germany

[21] Appl. No.: 789,514

[22] Filed: Jan. 27, 1997

[30] Foreign Application Priority Data

Jan. 25, 1996 [DE] Germany ..... 196 02 568.0

[51] Int. Cl.[6] ..... B41F 33/04

[52] U.S. Cl. ..... 101/218; 101/247

[58] Field of Search ..... 101/218, 247, 101/139, 140, 143, 144, 145, 183, 184, 185

[56] References Cited

U.S. PATENT DOCUMENTS

| | | | |
|---|---|---|---|
| 2,689,524 | 9/1954 | Wood | 101/218 |
| 2,874,636 | 2/1959 | Royer et al. | 101/218 |
| 3,046,881 | 7/1962 | Jurny' | 101/218 |
| 3,054,346 | 9/1962 | Koch et al. | 101/218 |
| 3,196,786 | 7/1965 | Hornberger et al. | 101/218 |
| 3,800,698 | 4/1974 | Kist et al. | 101/247 |
| 4,423,678 | 1/1984 | Matsumoto | 101/248 |
| 5,081,927 | 1/1992 | Jahn | 101/247 |
| 5,235,910 | 8/1993 | Tafel | 101/218 |
| 5,265,529 | 11/1993 | Tafel | 101/218 |
| 5,272,975 | 12/1993 | Dettinger et al. | 101/218 |
| 5,445,076 | 8/1995 | Sugiyama et al. | 101/218 |
| 5,644,983 | 7/1997 | Herrmann et al. | 101/218 |

FOREIGN PATENT DOCUMENTS

| | | |
|---|---|---|
| 0 591 792 A1 | 4/1994 | European Pat. Off. . |
| 297 117 A5 | 8/1990 | Germany . |

*Primary Examiner*—Eugene H. Eickholt

*Attorney, Agent, or Firm*—Herbert L. Lerner; Laurence A. Greenberg

[57] ABSTRACT

A device for effecting an impression throw-on and throw-off of a cylinder in a rotary printing press, the cylinder having a shaft supported in swivellably disposed bearing levers, includes respective guides located at respective ends of the shaft for setting the shaft in rotation.

8 Claims, 3 Drawing Sheets

DEVICE FOR EFFECTING AN IMPRESSION THROW-ON AND THROW-OFF OF A CYLINDER

BACKGROUND OF THE INVENTION

Field of the Invention

The invention relates to a device for effecting an impression throw-on and throw-off of a cylinder of a rotary printing press, the cylinder having a shaft which is supported in swivellingly disposed bearing levers.

Such a device has become known heretofore from the published German Patent Document DE 32 32 171 A1, which discloses a rubber-covered cylinder of a rotary printing press, the rubber-covered cylinder being eccentrically adjustably supported at the end of a bearing lever. In the rotary printing press, actuator cylinders are provided, which are respectively attached to the side frames of the press, the actuator cylinders, respectively, engaging with the bearing levers in order to position the rubber-covered cylinder.

In this heretofore known construction, slurring may occur due to skewing of the rubber-covered cylinder and, due to the existence of synchronized or ganged fluctuations, the slurring is unable to be prevented even when actuator cylinders engage with the bearing levers on both sides.

SUMMARY OF THE INVENTION

Consequently, it is an object of the invention to provide a device for effecting an impression throw-on and throw-off of a cylinder wherein a swivelling movement of the shaft of the cylinder is synchronized.

With the foregoing and other objects in view, there is provided, in accordance with the invention, a device for effecting an impression throw-on and throw-off of a cylinder in a rotary printing press, the cylinder having a shaft supported in swivellably disposed bearing levers, comprising respective guides located at respective ends of the shaft for setting the shaft in rotation.

In accordance with another feature of the invention, the guides are crank drives.

In accordance with a further feature of the invention, each of the crank drives includes a crank fixed on the shaft against rotation relative thereto, and a drive link rotatably mounted on the crank and swivellably supported on the side frame.

In accordance with an added feature of the invention, the crank and the drive link are disposed at an angle $\phi$ to one another.

In accordance with an additional feature of the invention, the cylinder is rotatably supported on the shaft, and adjustable eccentric bushings are provided for supporting the shaft in the bearing levers.

In accordance with yet another feature of the invention, the device according to the invention includes an actuating device disposed on at least one of the bearing levers for positioning the bearing lever.

In accordance with yet a further feature of the invention, the actuating device is an actuator cylinder fixed to the press frame.

In accordance with a concomitant feature of the invention, the cylinder is a rubber-covered cylinder in cooperative engagement with a cylinder bearing an image to be printed.

An advantage of the invention, in particular, is that it is possible therewith to maintain, within a narrow tolerance range (approximately 0.02 mm), the parallelism of the shaft of the swivellable cylinder, e.g., a rubber-covered or rubber-blanket cylinder (offset cylinder), relative to the shaft of an adjacent cylinder, e.g., an image-bearing cylinder (plate cylinder), of a rotary printing press. Heretofore known socalled "slurring" upon impression throw-on and throw-off of cylinders in a rotary printing press can thus be virtually prevented, and the print quality improved.

The construction of the shaft guides according to the invention in the form of crank drives is relatively simple so that they are, consequently, manufacturable quite economically.

Furthermore, it is possible, with the crank drive, to include an additional actuating movement of the shaft of the cylinder to be adjusted, the additional actuating movement being produced by an eccentric bushing which effects the throw-off of the rubber-covered cylinder from the plate cylinder.

The arrangement of the articulated elements (crank, drive link) of the crank drive at an angle $\phi$ of approximately 90° with respect to one another minimizes the forces occurring in the articulated elements, thereby making it possible for the articulated elements to be of small dimensions.

In an advantageous embodiment, an actuator cylinder is provided for each bearing lever on both sides of the side frame, for positioning the respective bearing lever.

With the synchronizing device according to the invention, it is, however, also possible to provide just one actuator cylinder, disposed on any side.

Other features which are considered as characteristic for the invention are set forth in the appended claims.

Although the invention is illustrated and described herein as embodied in a device for effecting an impression throw-on and throw-off of a cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
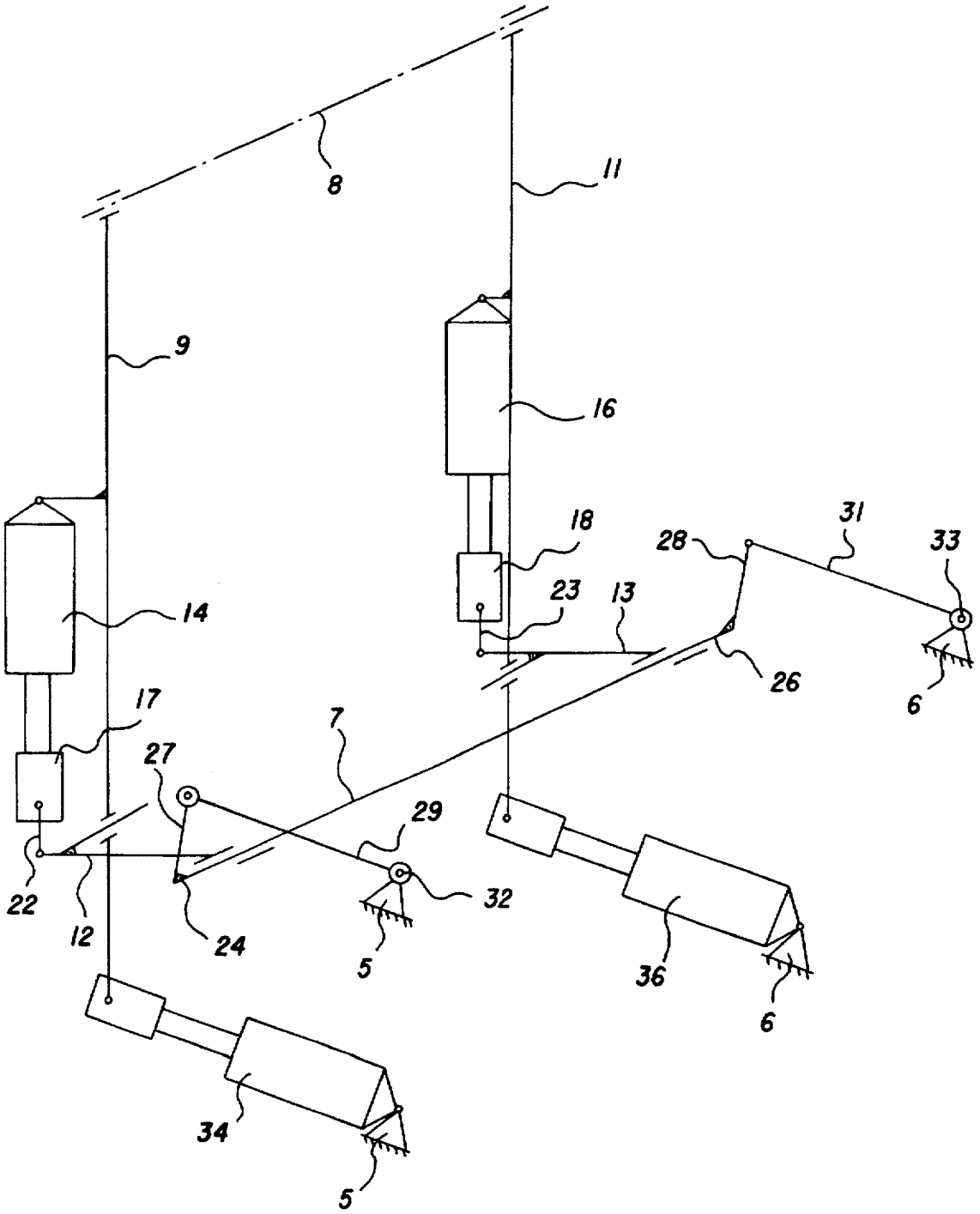
FIG. 1 is a diagrammatic representation of a device for effecting an impression throw-on and throw-off of a cylinder in accordance with the invention.
Figure 2:
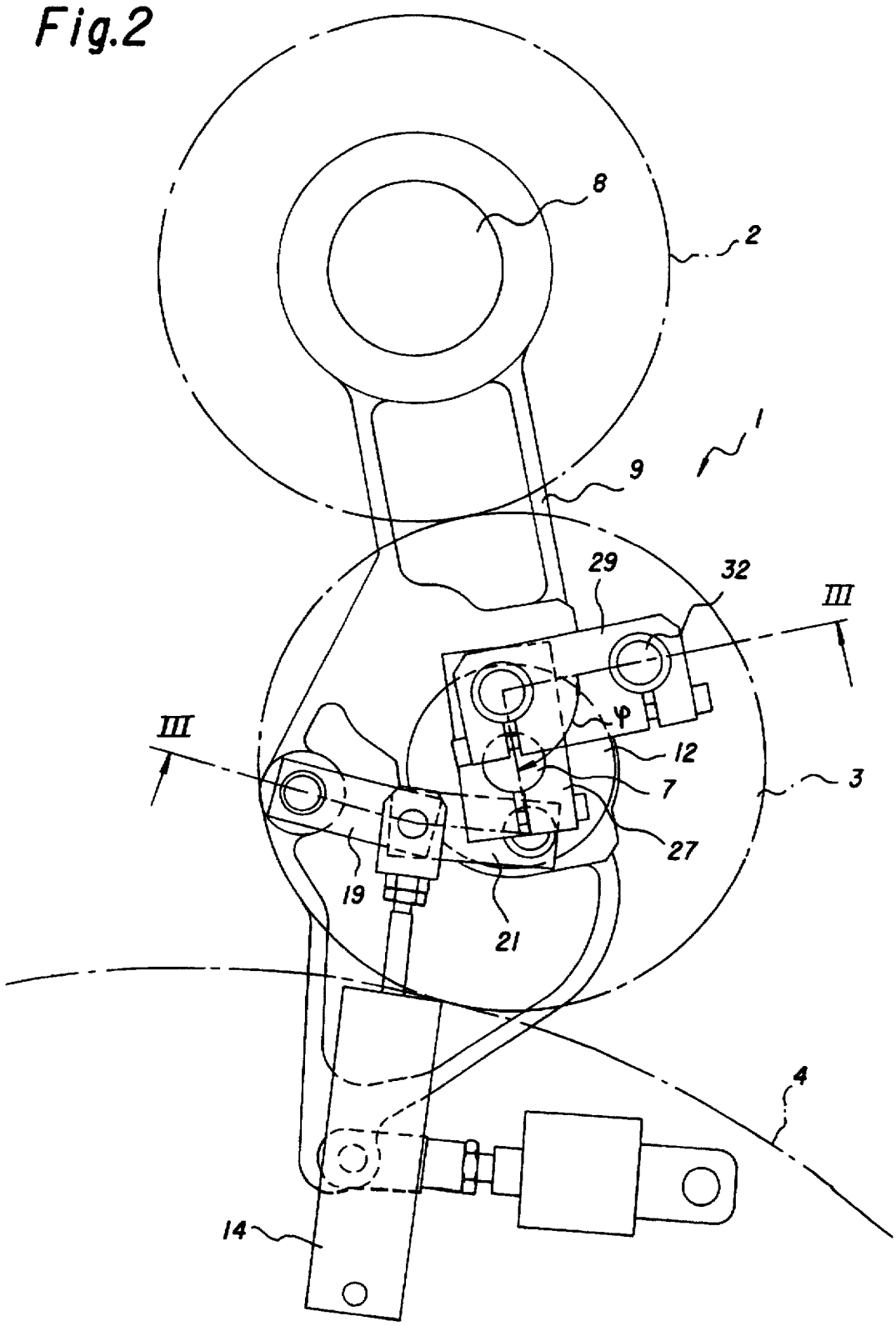
FIG. 2 is a fragmentary side elevational view of a printing unit of a rotary press showing a bearing lever for the shaft of a cylinder in accordance with the invention.
Figure 3:
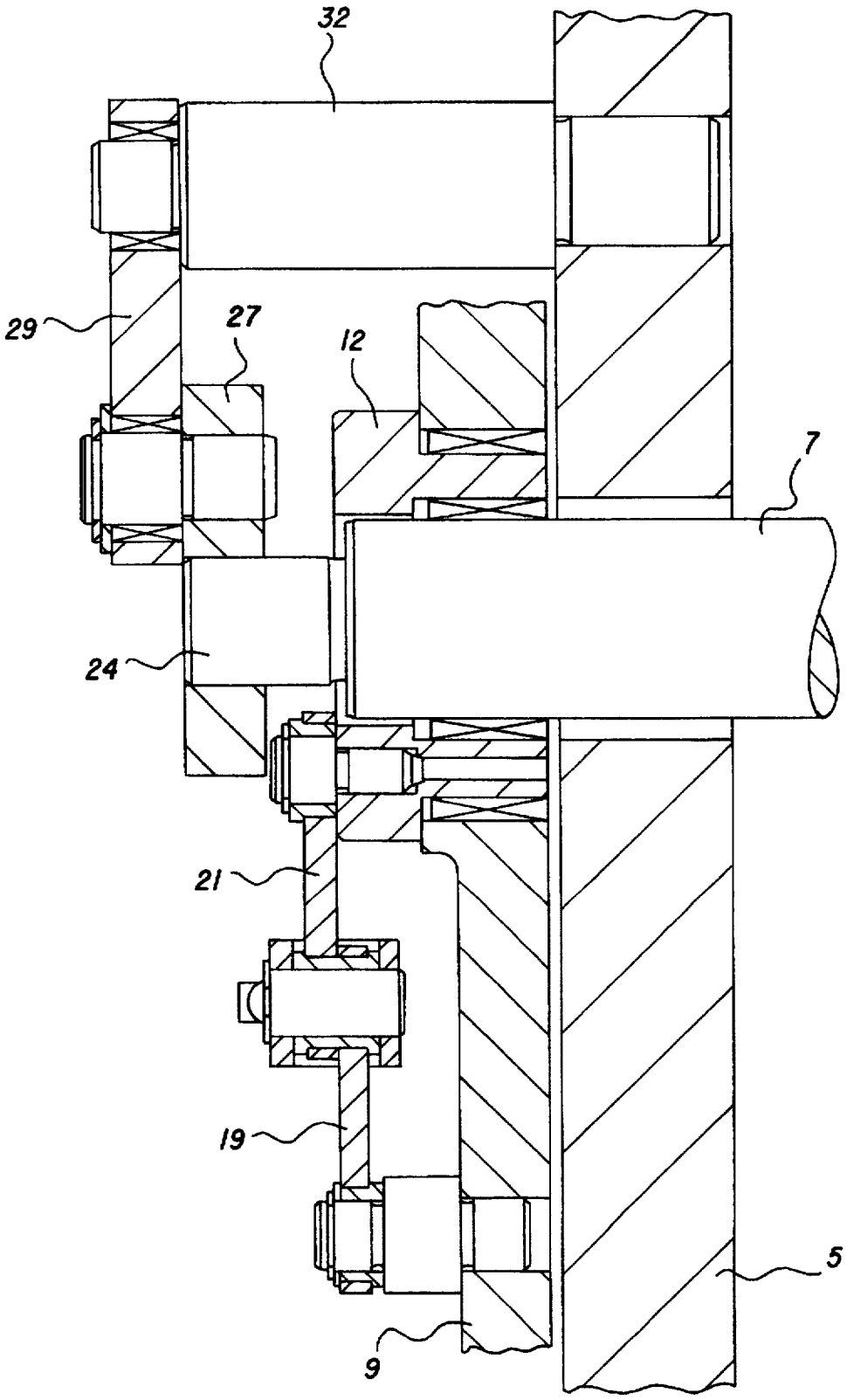
FIG. 3 is a cross-sectional view of FIG. 2 taken along the line III—III in the direction of the arrows.

Referring now to the drawings, there is shown therein a printing unit 1 of a rotary printing press including, inter alia, a plate cylinder 2, a rubber-covered cylinder 3 cooperating therewith and an impression cylinder 4. The plate cylinder 2 and the impression cylinder 4 are rotatably supported or journalled in side frames 5, 6 of the rotary printing press. The rubber-covered cylinder 3 is rotatably supported or journalled on a shaft 7, which, in turn, is rotatably supported or journalled in two bearing levers 9, 11, which are disposed, respectively, outside the side frames 5, 6 and are swivellable about the shaft 8 of the plate cylinder 3. Due to this arrangement, the rubber-covered cylinder 3 remains in engagement with the plate cylinder 2 during impression throw-on/impression throw-off. The shaft 7 is journalled in each of the bearing levers 9 and 11 by a respective adjustable eccentric bushing 12, 13. Due to this feature, it is possible, in the case of a throw-off from the impression cylinder 4, for the rubber-covered cylinder 3 additionally to be disengaged from the plate cylinder 2. To effect adjustments of the eccentric bushings 12, 13, actuator cylinders 14, 16 are swivellably supported on the bearing levers 9, 11 and, respectively, engage, by an end of the respective piston rod 17, 18, thereof, a toggle-lever mechanism 22, 23 formed of two levers 19 and 21. The toggle-lever mechanisms 22 and 23, respectively, are disposed with the first lever 19 articulatedly on the respective bearing levers 9 and 11, and with the second lever 21 articulatedly on the respective eccentric bushings 12 and 13. The ends 24 and 26 at both sides of the shaft 7 of the rubber-covered cylinder 3 project without contact through the respective side frames 5 and 6 and through the respective eccentric bushings 12 and 13 and respectively carry a crank 27, 28 fixed against rotation relative to the shaft 7 at each of the ends 24 and 26. The cranks 27 and 28, respectively, are swivellably connected to respective drive links 29 and 31, which are rotatably supported or journalled on respective bolts 32 and 33 fixed to the press frame. An angle $\phi$ between the respective crank 27, 28 and the respective drive link 29, 31 is, for example, approximately 90°.

When the rubber-covered cylinder 3 is thrown off from the impression cylinder 4, the bearing levers 9 and 11 in the illustrated embodiment are swivelled counter-clockwise about the shaft 8 of the plate cylinder 2 by actuator cylinders 34 and 36 fixed to the press frame and engaging with the bearing levers 9 and 11, respectively. The guides in the form of the crank drives 27 and 29, on the one hand, and 28 and 31, on the other hand, cause, at each shaft end 24 and 26, a rotational movement of the shaft 7, likewise counter-clockwise and in synchronism with the swivelling movement of the bearing levers 9 and 11. The swivelling of the shaft 7 and, therefore, of the rubber-covered cylinder 3 is effected parallel to the shaft 8 and to the plate cylinder 2.

At impression throw-off, it is possible, by means of the eccentric bushings 12 and 13, for the rubber-covered cylinder 3 to be disengaged from the plate cylinder 2, in that the piston rods 17 and 18 of the respective actuator cylinders 14 and 16 are retracted and the respective toggle-lever mechanisms 22 and 23 are deflected.

For impression throw-on, the procedure is identical but in the reverse order. Due to the arrangement of the respective crank-drive guides 27 and 29, on the one hand, and 28 and 31, on the other hand, in accordance with the invention, it is also possible, for example, to provide just one actuator cylinder 34 or 36.

I claim:

1. A device for effecting an impression throw-on and throw-off of a cylinder in a rotary printing press, the cylinder having a shaft supported in swivellably disposed bearing levers, comprising respective guides located at respective ends of the shaft for setting the shaft in rotation.

2. The device according to claim 1, wherein the guides are crank drives.

3. The device according to claim 2, wherein each of said crank drives includes a crank fixed on the shaft against rotation relative thereto, and a drive link rotatably mounted on said crank and swivellably supported on the side frame.

4. The device according to claim 3, wherein said crank and said drive link are disposed at an angle $\phi$ to one another.

5. The device according to claim 1, wherein the cylinder is rotatably supported on the shaft, and including adjustable eccentric bushings for supporting the shaft in the bearing levers.

6. The device according to claim 1, including an actuating device disposed on at least one of the bearing levers for positioning the bearing lever.

7. The device for effecting an impression throw-on and throw-off according to claim 6, wherein said actuating device is an actuator cylinder fixed to the press frame.

8. The device according to claim 1, wherein the cylinder is a rubber-covered cylinder in cooperative engagement with a cylinder bearing an image to be printed.

* * * * *

US005791246C1

(12) REEXAMINATION CERTIFICATE (4802nd)

United States Patent

Kelm

(10) Number: US 5,791,246 C1

(45) Certificate Issued: Jul. 1, 2003

(54) DEVICE FOR EFFECTING AN IMPRESSION THROW-ON AND THROW-OFF OF A CYLINDER

(75) Inventor: Carsten Kelm, Mannheim (DE)

(73) Assignee: Heidelberger Druckmaschinen AG, Heidelberg (DE)

Reexamination Request:
No. 90/005,375, Jun. 15, 1999

Reexamination Certificate for:

| | |
|---|---|
| Patent No.: | **5,791,246** |
| Issued: | **Aug. 11, 1998** |
| Appl. No.: | **08/789,514** |
| Filed: | **Jan. 27, 1997** |

(30) Foreign Application Priority Data

Jan. 25, 1996 (DE) ..... 196 02 568

(51) Int. Cl.[7] ..... B41F 33/04

(52) U.S. Cl. ..... 101/218; 101/247

(58) Field of Search ..... 101/247, 218, 101/138–140, 144–145, 182, 184–185, 191–192, 209

(56) References Cited

U.S. PATENT DOCUMENTS

| | | | | | |
|---|---|---|---|---|---|
| 2,982,204 | A | | 5/1961 | Roehm | |
| 4,372,204 | A | * | 2/1983 | Herzan et al. | 101/247 |
| 5,235,910 | A | * | 8/1993 | Tafel | 101/218 |
| 5,644,983 | A | * | 7/1997 | Herrmann et al. | 101/247 |
| 5,690,029 | A | * | 11/1997 | Herrmann et al. | 101/247 |
| 5,791,246 | A | * | 8/1998 | Kelm | 101/218 |

FOREIGN PATENT DOCUMENTS

| | | | | |
|---|---|---|---|---|
| DE | 3232171 | * | 7/1983 | 101/247 |
| DE | 0236699 | * | 6/1985 | 101/247 |
| DE | 41 42 792 A1 | | 6/1993 | |
| GB | 943987 | | 12/1963 | |
| GB | 1 377 016 | | 12/1974 | |

* cited by examiner

*Primary Examiner*—Eugene H. Eickholt

(57) ABSTRACT

A device for effecting an impression throw-on and throw-off of a cylinder in a rotary printing press, the cylinder having a shaft supported in swivellably disposed bearing levers, includes respective guides located at respective ends of the shaft for setting the shaft in rotation.

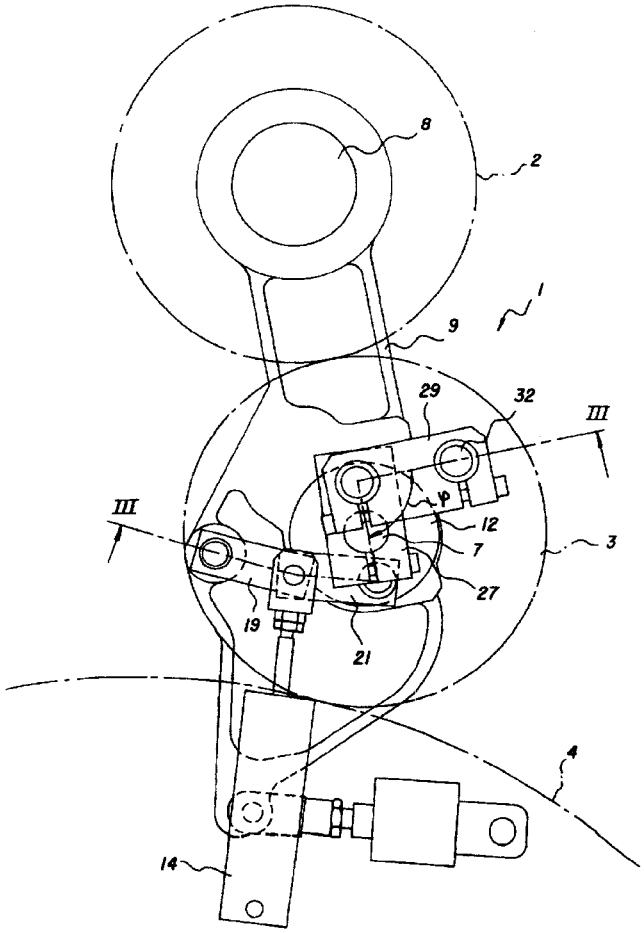

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 and 5–8 are determined to be patentable as amended.

Claim 4, dependent on an amended claim, is determined to be patentable.

1. A device for effecting an impression throw-on and throw-off of a cylinder in a rotary printing press, [the cylinder having a shaft supported in swivellably disposed bearing levers, comprising respective guides located at respective ends of the shaft for setting the shaft in rotation] *comprising:*

*swivellably disposed bearing levers;*

*a cylinder having a shaft and being rotatably supported thereon, said shaft having ends and being supported in*

*said swivellably disposed bearing levers, said shaft defining an axis therethrough; and*

*guides for setting said shaft in rotation about said axis, one of said guides being located at each of said ends of said shaft.*

2. The device according to claim 1, wherein [the] *said* guides are crank drives.

3. The device according to claim 2, *including a frame, and* wherein each of said crank drives includes a crank fixed on [the] *said* shaft against rotation relative thereto, and a drive link rotatably mounted on said crank and swivellably supported on [the side] *said* frame.

5. The device according to claim 1, [wherein the cylinder is rotatably supported on the shaft, and] including adjustable eccentric bushings for supporting [the] *said* shaft in [the] *said swivellably disposed* bearing levers.

6. The device according to claim 1, including an actuating device disposed on at least one of [the] *said* bearing levers for positioning [the bearing lever] *said bearing levers*.

7. The device [for effecting an impression throw-on and throw-off] according to claim 6, *including a frame, and* wherein said actuating device is an actuator cylinder fixed to [the press] *said* frame.

8. The device according to claim 1, wherein [the] *said* cylinder is a rubber-covered cylinder in cooperative engagement with a cylinder bearing an image to be printed.

* * * * *